US005819849A

United States Patent [19]

Booth

[11] Patent Number: 5,819,849

[45] Date of Patent: Oct. 13, 1998

[54] METHOD AND APPARATUS FOR CONTROLLING PUMP OPERATIONS IN ARTIFICIAL LIFT PRODUCTION

[75] Inventor: Kenneth G. Booth, Houston, Tex.

[73] Assignee: Thermo Instrument Controls, Inc., Austin, Tex.

[21] Appl. No.: 346,962

[22] Filed: Nov. 30, 1994

[51] Int. Cl.[6] ..... E21B 43/00

[52] U.S. Cl. ..... 166/252.1; 166/53

[58] Field of Search ..... 166/252.1, 369, 166/53; 340/853.3, 853.9

[56] References Cited

U.S. PATENT DOCUMENTS

| | | | |
|---|---|---|---|
| Re. 33,690 | 9/1991 | Adams, Jr. et al. | 166/53 |
| 3,921,152 | 11/1975 | Itasar et al. | 166/66 X |
| 4,102,394 | 7/1978 | Botts | 166/66 |
| 4,307,395 | 12/1981 | Standish | 166/66 X |
| 4,581,613 | 4/1986 | Ward et al. | 340/856 |
| 4,631,536 | 12/1986 | Ward et al. | 340/857 |
| 4,767,280 | 8/1988 | Markuson et al. | 166/53 X |
| 4,803,483 | 2/1989 | Vandervier et al. | 340/856 |
| 4,901,070 | 2/1990 | Vandevier | 340/856 |
| 5,064,348 | 11/1991 | McKee et al. | 417/12 |

*Primary Examiner*—William P. Neuder
*Attorney, Agent, or Firm*—Melvin A. Hunn

[57] ABSTRACT

A method and apparatus for controlling an artificial lift system is described and claimed. Preferably, the control system includes at least one sensor for detecting at least one mechanical attribute during pumping operations, and a controller for receiving the electrical signal as an input, and analyzing it to determine if a pumped-off condition is occurring. Additionally, the controller member provides command signals to control the prime mover and to suspend operation of the prime mover if it is determined that a pumped-off condition is occurring. The controller maintains the suspension of the prime mover for an idle interval having a duration which is calculated by the controller from (1) at least one preceding pumping interval, and (2) a predefined pump cycle duration. Preferably, the controller operates to maintain a substantially constant and predetermined pumping cycle duration by continuously adjusting the idle interval duration.

23 Claims, 10 Drawing Sheets

METHOD AND APPARATUS FOR CONTROLLING PUMP OPERATIONS IN ARTIFICIAL LIFT PRODUCTION

BACKGROUND OF THE INVENTION

1. Field of the Invention

The present invention relates in general to artificial lift pumping in oil and gas wellbores, and in particular to control systems which limit pump operation when the wellbore is in a pumped-off condition, and still more particularly to a control system which stabilizes the pump-off cycle.

2. Description of the Prior Art

In the oil and gas industry, two commonly used of artificial lift pumping units are sucker rod pumping units and submersible pumps.

Sucker rod pumping units are utilized to lift producible fluids, which include oil and water, from a location in the wellbore adjacent a standing valve which is coupled to, and communicating with, a production tubing string, through the lifting action of a traveling valve which is coupled to a sucker rod which extends downward from the earth's surface into the wellbore through the central bore of the production tubing string. The sucker rod is coupled to a walking-beam type which is located at the surface and which includes a walking beam which is moved upward and downward through an arc to raise and lower the sucker rod (and connected traveling valve) relative to the production tubing string, in response to the operation of a prime mover, which is typically a powerful an internal combustion engine or electrical motor.

The producible fluids flow from the earth's formation into the cased wellbore through perforations in the casing, and the producible fluids accumulate in the annular region between the production tubing string and the wellbore casing. As the traveling valve is reciprocated upward and downward relative to the standing valve, producible fluids are directed from the standing valve into the traveling valve. The valves are arranged to direct the flow of producible fluids from the wellbore into the production tubing string, and to check backward flow of the producible fluids. Of course, producible fluids must be present within the standing valve before production of fluids can occur. Since it is difficult to match a particular sucker rod pumping unit's lifting capacity to the maximum possible production of a particular oil and gas wellbore, and since operators generally want to accelerate production, sucker rod pumping units typically can lift fluids from the wellbore far faster than the surrounding formation can fill the annular region between the production tubing string and the wellbore casing.

When an insufficient amount of fluid remains within the wellbore, the well is considered to be in a "pumped-off" condition. The pumped-off condition is undesirable for a number of reasons. First, electrical energy is consumed by the prime mover at the surface to reciprocate the sucker rod pumping unit unnecessarily during periods of time when production is not possible. Second, operation of the sucker rod pumping unit when the well is in a pumped-off condition results in excessive and unnecessary wear of the mechanical components which make up the sucker rod, standing valve, and traveling valve. Studies indicate that the mechanical wear which results from the operation of a sucker rod pumping unit during pumped-off periods results in far greater wear than that encountered during normal operating conditions, when the well contains a sufficient amount of fluid for production to occur. Numerous techniques have been utilized in the prior art to stop the operation of sucker rod pumping units during periods of time which correspond to the well being in a pumped-off condition.

The first solution proposed and adopted by the oil and gas industry was the utilization of a "percentage timer". These devices are merely timed electrical switches which are connected between a source of electrical energy and the prime mover, and which serve to decouple the prime mover from the source of electrical energy for predefined time intervals. Before a percentage timer can be utilized, the well must be studied to determine how much time is required to remove the producible wellbore fluids from the wellbore during normal pumping operations. Additionally, an estimate must be made of the amount of time required for producible fluids to be drained from the surrounding formation into the wellbore. Once these values are known, the timer may be manually set to allow a predefined period of normal pumping operations before the electrical power to the prime mover is interrupted for a second predefined time interval which allows producible fluids to flow from the formation into the wellbore. Percentage timers are still being utilized in the oil and gas industry, but present a rather crude solution to the problem, since it is still possible that pumping operations terminate too soon, thus leaving valuable producible fluids within the wellbore, just as it is possible to terminate pumping operations not soon enough, thus causing waste of (not inexpensive) electrical energy and subjecting the subsurface well components, in particular, to rather excessive and potentially catastrophic wear and damage.

In order to provide more accurate control over the wellbore, pump-off controllers were introduced into the oil and gas industry. The first type of pump-off controllers provided a load sensor between the sucker rod and the "horse's head" portion of the walking beam to provide an electrical measure of the load on the sucker rod. Additionally, a position sensor was utilized to provide an electrical indication of the position of the walking beam. This was accomplished by providing a position sensor on the walking beam which provided a measure of the position of the walking beam, or a position sensor which provided an indication of the position of the prime mover. These devices operated on the principle that the load on the sucker rod should not vary significantly from a predefined load amount for a particular position of the sucker rod. The pump-off controllers operated by continuously or intermittently comparing the values of load and position to the preset values of load and position, and switching off power to the prime mover if a particular load threshold was violated. While these devices were still relatively crude, they provided a much greater degree of control over the sucker rod pumping unit than that which was provided by time percentage timers.

Additional innovation occurred in the prior art by the introduction of microprocessor-implemented pump-off controllers which also included load and position sensors to provide data to the microprocessor which was utilized to calculate and/or identify the shape, position, or area of the load and position data points which were recorded in memory. Alternatively, load and time data can be utilized to determine if a pumped-off condition is occurring. The microprocessor-based pump-off controllers typically provided greater control and accuracy than could be expected from the first generation of pump-off controllers which operated by analyzing the load on the sucker rod at a predetermined sucker rod position.

The principal alternative to the utilization of sucker rod pumping units is submersible pumps which are disposed deep within the wellbore, within the wellbore fluids, and energized through a power-transmission cable which is suspended within the wellbore along the production tubing string. A plurality of prior art systems exist for monitoring the operating conditions of the submersible pump. The fluid pressure and temperature are of particular interest. Typically, one or more sensors are provided within the wellbore to derive information pertaining to the operation of the submersible pump. The information is typically impressed upon the suspended power cable, and detected with detection equipment located at the surface. Submersible pumps can become damaged when they are operated with little or no fluid within the wellbore. It is advisable that the power to the submersible pump be interrupted to prevent the pumps from such wasteful and potentially damaging operation. It is conventional to derive information about the operating condition of the submersible pump from the voltage and current characteristics of the power supply to the submersible pump through the suspended power cable, as well as through data transmitted to the surface which pertain to one or more wellbore conditions.

While significant increases in control over artificial lift systems have been accomplished through utilization of micro-processor based control systems, the industry in general seeks still greater levels of control in order simultaneously to reduce the potentially injurious continuation of pumping when the well is in a pumped-off condition, to suspend operation of the artificial lift system for the minimum interval necessary to replenish the wellbore with production fluids, and to maximize and accelerate the production of hydrocarbons from the wellbore. One prior art approach to managing these competing interest is set forth in U.S. Pat. No. 5,064,348, entitled "Determination of Well Pumping System Down Time", which is owned by Delta-X Corporation of Houston, Tex. The approach suggested in this prior art reference is to determine the duration of the idle time by analyzing the relationship between idle time and run time, and in particular by identifying any non-linearity in this mathematical relationship between idle time and run time. Unfortunately, this technique is not effective because, in general, this relationship between idle time and run time does not indicate the same non-linear characteristics as does the relationship between fluid production and idle time. The result is that the idle time determined in accordance with this prior art technique is often too long, causing a loss of production. An industry need exists for an improved, more efficient, and more accurate technique for determining the duration of idle times in controllers used in artificial lift systems.

SUMMARY OF THE INVENTION

The present invention is directed to a method and apparatus for controlling pump operations in artificial lift production. The present invention may be characterized either as a control system for use with an artificial lift system, or as a method of controlling an artificial lift system.

When characterized as a control system for use with an artificial lift system, which operates to lift production fluid from a wellbore in response to operation of a prime mover, the invention includes a number of components which cooperate. At least one sensor is provided for detecting at least one mechanical attribute during pumping operations and for developing at least one electrical signal corresponding thereto. A controller member is provided. The controller member receives the at least one electrical signal as an input, and analyzes the at least one electrical signal in order to determine if a pumped-off condition is occurring. The controller provides command signals to the prime mover to suspend operation if it is determined that a pumped-off condition is occurring. Additionally, the controller member maintains suspension of the prime mover for an idle interval having a duration which is calculated by the controller from (1) at least one preceding pumping interval, and (2) a predefined pump cycle duration.

Preferably, the controller member comprises a microcomputer with memory, and a program resident in memory which executes instructions in order to accomplish predetermined program objectives. With respect to the present invention, the overall objective is to stabilize pumping cycles, which are defined as the duration of consecutive pumping intervals and idles intervals. Preferably, the controller member is utilized to maintain a substantially constant and predetermined pumping cycle duration, by continuously adjusting the idle interval duration. In accordance with the preferred embodiment of the present invention, when increases in the duration of the pumping interval are experienced, the controller calculates a decreasing idle interval duration, in order to maintain the pumping cycle duration substantially constant. Conversely, when decreases are experienced in the duration of the pumping interval, the controller calculates an increasing idle time interval, also in order to maintain the pumping cycle duration substantially constant.

The control system of the present invention may be utilized with any type of artificial lift system which is utilized to lift production fluids from an oil and gas wellbore, including submersible pumps and sucker rod pumping units, but is likely to find greatest applicability in sucker rod pumping units, since microprocessors-based control systems are widely utilized to control sucker rod pumping units and to prevent pumping during intervals when the well is in a pump-off condition.

The present invention may also be characterized as a method of controlling an artificial lift system, which operates to lift production fluid from a wellbore in response to operation of a prime mover, and includes a number of method steps. At least one pump-off detection sensor is provided for detecting a pumped-off condition in the wellbore. A controller member is provided. The controller member is utilized to substantially continuously monitor the at least one pump-off detection sensor during pumping operations, and to suspend operation of the prime mover upon detection of a pumped-off condition for an idle interval. The controller member is also utilized to calculate a duration for the idle interval from (1) at least one preceding pumping interval, and (2) a predefined pump cycle duration. Preferably, the controller member operates to maintain a substantially constant and predetermined pumping cycle by continuously adjusting the idle interval.

Additional objectives, features and advantages will be apparent in the written description which follows.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE INVENTION

Figure 1A:
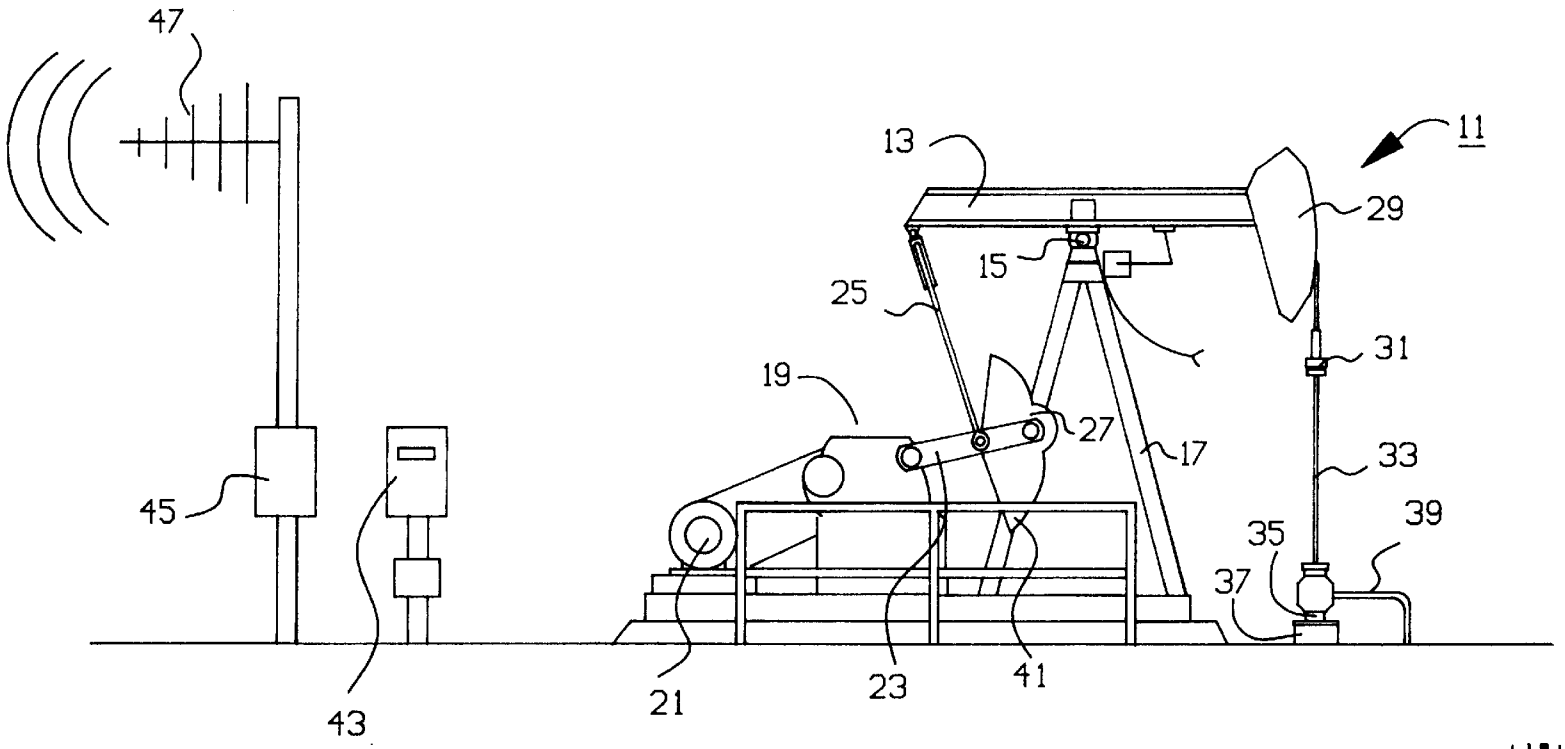
FIGS. 1A and 1B depict in simplified a sucker rod pumping unit located at a wellbore site, and the subterranean components of the sucker rod pumping unit at a wellbore site.

FIG. 1A depicts the operating components of a sucker rod pumping unit 11. As is shown, walking beam 13 is pivotally connected at pivot point 15 to stationary samson post 17, and is moved through an arc by the operation of prime mover 19 which includes electrical motor 21 which is utilized to drive crank arm 23 and crank arm 25 in a circular pattern, with counterweight 27 balancing this arrangement. Walking beam 13 terminates at one end at horse's head 29 which is adapted for coupling through load cell 31 to sucker rod 33 which extends downward within production tubing string 35 at well head 37. The flowline 39 is provided for routing production fluids, which are lifted upward within production tubing string 35 by the operation of sucker rod 33, to storage tanks. A position switch 41 may be provided on the prime mover assembly for identifying the commencement of either a downstroke of sucker rod 33 or an upstroke of sucker rod 33. Electrical cables direct the load and position data to remote terminal unit (RTU) 43 which stores and processes the data and intermittently communicates a data package to radio unit 45 which is utilized to energize antenna 47 to communicate pump operation data to a centralized monitoring unit which includes radio receiving equipment and data processing equipment for receiving, decoding, and storing the load and position data. These components together comprise a conventional rod pump controller, such as the 8800 Rod Pump Controller which is manufactured by Baker CAC, of Kingwood, Tex., a division of Thermo Instrument Controls, Inc. of Austin, Tex.

Figure 1B:
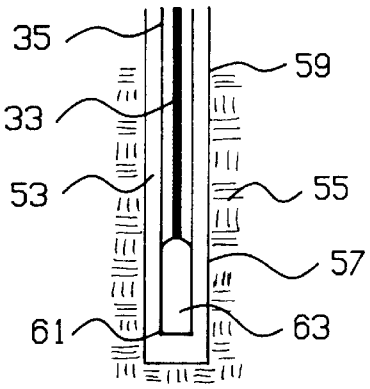

FIG. 1B depicts, in simplified form, the subterranean components of sucker rod pumping unit 11. As is shown in this view, sucker rod 33 is disposed concentrically within the central bore of production tubing string 35. Producible fluids, such as formation water and oil, are drained from formation 55 which surrounds wellbore 59, and enters annulus 53 of wellbore 59 through perforations 57 in the casing of wellbore 59. Wellbore fluid enters standing valve 61 which is coupled at a lowermost position of production tubing string 35, and is lifted upward by traveling valve 63 which is coupled to the lowermost portion of sucker rod 33 as it is reciprocated. In accordance with the present invention, the operation action of the standing and traveling valves creates a fluid column within production tubing string 35 which is incrementally advanced upward as a "slug" of fluid is added to the fluid column by the action of the traveling and standing valves 63, 61.

If the undesired pump-off condition is commencing or if it can be determined from the analysis that one or more components of the sucker rod pump assembly are malfunctioning or about to malfunction, the central processing unit may send a command signal via radio waves for reception by antenna 47, and processing by radio unit 45 and RTU 43, in a manner which results in the interruption of electrical power to prime mover 21 to cease the reciprocating action of sucker rod pumping unit 11 to prevent pumping during a pumped-off condition, to save electrical energy, and to prevent the operation of the pumping unit when mechanical components are failing or are about to fail. Alternatively, a local processing unit can perform predetermined calculation to determine if pump-off has occurred.

Figure 2A:
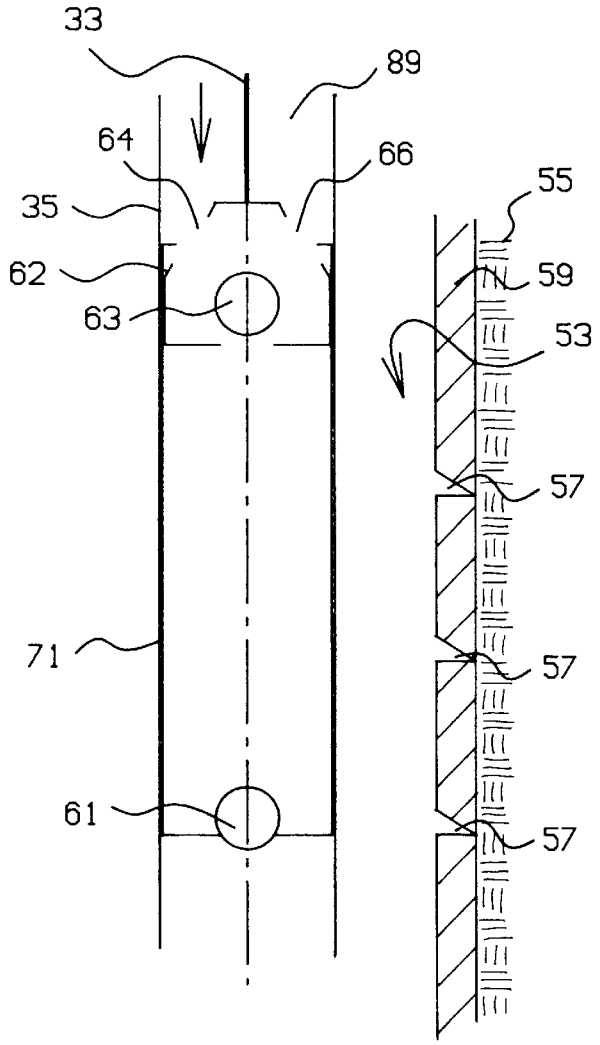
FIGS. 2A, 2B, 2C, and 2D depict in schematic form the pumping cycle of a sucker rod pumping unit.
Figure 2B:
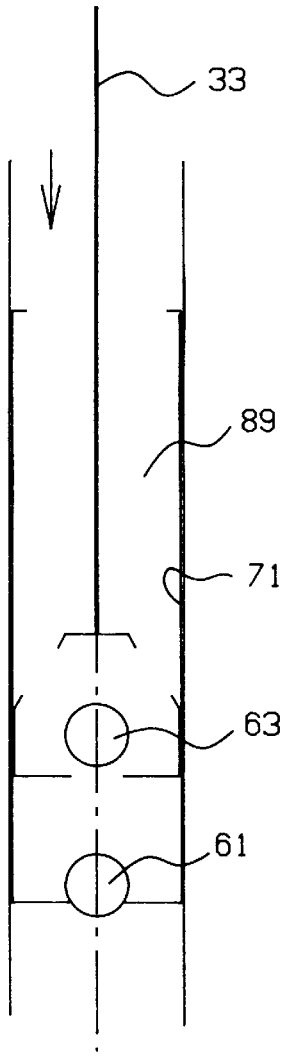
Figure 2C:
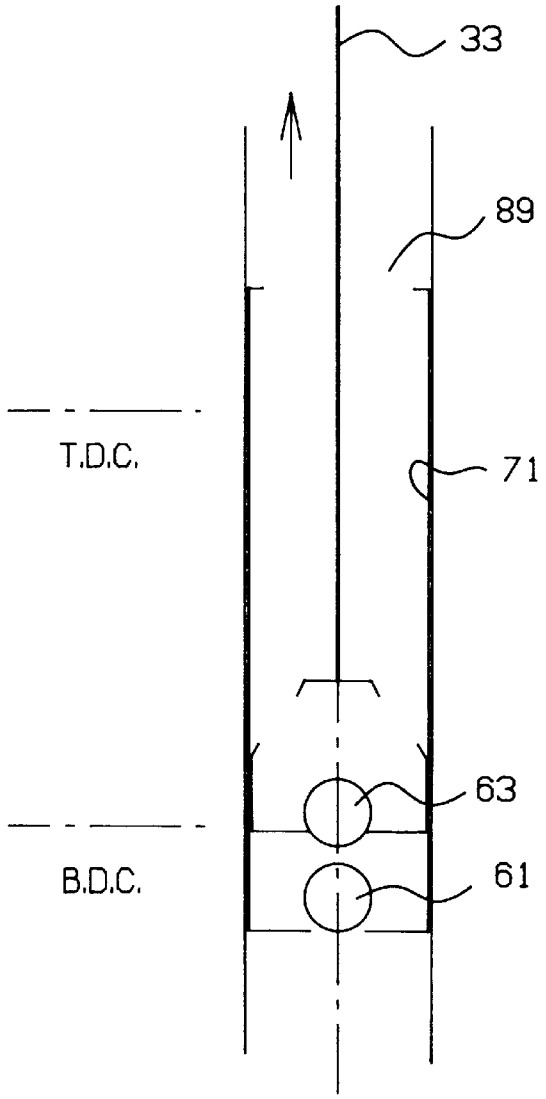
Figure 2D:
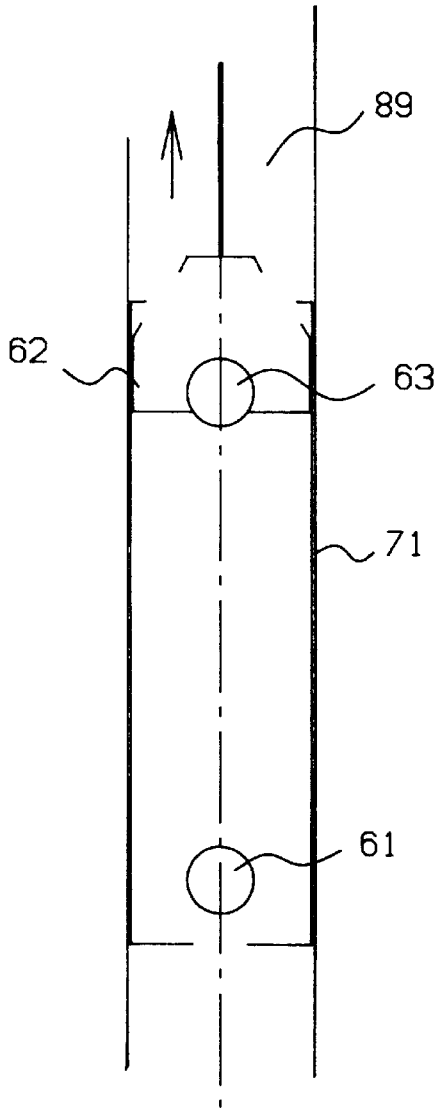

FIGS. 2A, 2B, 2C, and 2D depict in schematic form the pumping cycle of a sucker rod pumping unit. As is depicted in FIG. 2A, barrel 71 is coupled to the lowermost end of production tubing string 35. Traveling valve 63 is disposed within barrel 71 and coupled to the lowermost end of sucker rod 33. Standing valve 61 is disposed at the lowermost end of barrel 71. In operation, fluid is drained from formation 55 through perforations 57 in casing 59. Fluid enters barrel 71 through standing valve 61. Plunger 62 defines the housing for traveling valve 63. Reciprocation of sucker rod 33 causes the upward and downward movement of plunger 62 within barrel 71. Fluid passes through traveling valve 63, then through ports 64, 66 in plunger 62, and then upward through production tubing string 35 which has a fluid column 89 defined therein. FIGS. 2A and 2B depict a downstroke in a pumping cycle, while FIGS. 2C and 2D depict an upstroke in a pumping cycle.

The beginning of the down stroke is depicted in FIG. 2A, while the end of the downstroke is depicted in FIG. 2B. At the beginning of the downstroke, plunger 62 is located at an upper portion of barrel 71. The weight of fluid column is applied through ports 64, 66, to traveling valve 63, biasing it to a closed position. In this position, the entire weight of the fluid column is supported by sucker rod 33. The weight of the fluid column 89 serves to close traveling valve 63 as soon as fluid stops moving through traveling valve 63. Supposing that barrel 71 is partially or completely filled with fluid, as plunger 62 moves downward, it enters the fluid, and traveling valve 63 opens. At this time, the full weight of the fluid column 89 rests on standing valve 61, and thus on production tubing string 35. A certain amount of fluid is displaced, and is delivered into fluid column 89 within production tubing string 35.

At the beginning of the upstroke, which is depicted in FIG. 2C, traveling valve 63 closes again, due to the weight of fluid column 89. At this point, the load of fluid column 89 is transferred back to polished rod 33. As is depicted in FIG. 2D, standing valve 61 opens when the intake pressure (of the wellbore fluid) exceeds the pressure in barrel 71. Until the end of the upstroke, production fluids from the formation flow into the evacuated barrel 71. At the same time, an equal amount of fluid is delivered by plunger 62 which is lifting fluid column 89.

Figure 3A:
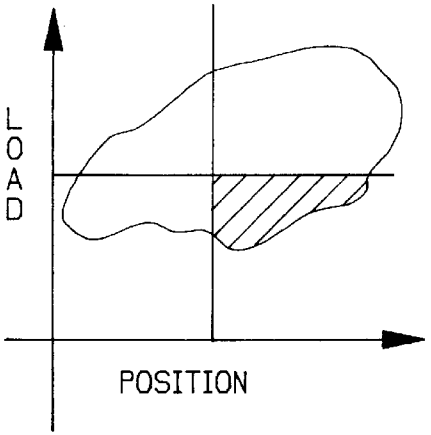
FIGS. 3A, 3B, 3C, and 3D depict two prior art techniques for detection of pump-off in a well.
Figure 3B:
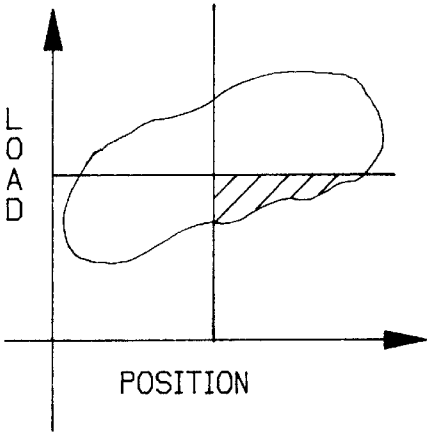

Several prior art techniques are known for receiving sensor data from one or more sensors and utilizing the sensor data to determine whether a pumped-off condition exists or not. FIGS. 3A, 3B, 3C, and 3D graphically depict two of the common techniques for receiving sensor data and determining whether a well is in a pumped-off condition. In accordance with the technique of FIGS. 3A and 3B, all or a portion of a dynograph (which is a plot of load versus position data) is examined to detect diminishment in area, which corresponds to a diminishment in the work performed by the sucker rod pump during a particular pump stroke. FIG. 3A is a graphical depiction of the load versus position data dynograph of a pump stroke when the well is sufficiently full of fluid. All or a portion (such as the lower right-hand quadrant) of the load versus position data may be integrated to determine an area. FIG. 3B is a graphical depiction of the load versus position data for the same well when the well is in a pumped-off condition. Note that the area of the lower right-hand quadrant is less in value than that of FIG. 3A. As stated, in alternative embodiments, the entire area of the load versus position data may be examined to determine whether a pump-off condition exists. Typically, a human operator sets the area threshold for the detection of the pumped-off condition, typically by viewing the load versus position data for numerous pump cycles, until pump-off occurs.

Figure 3C:
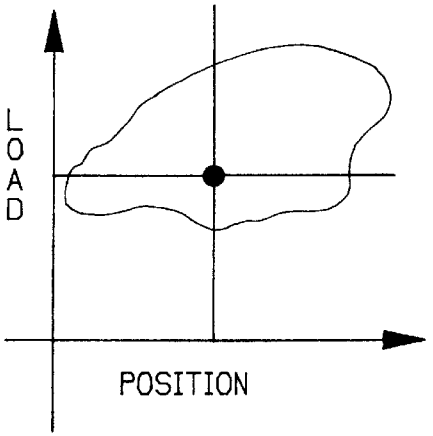
Figure 3D:
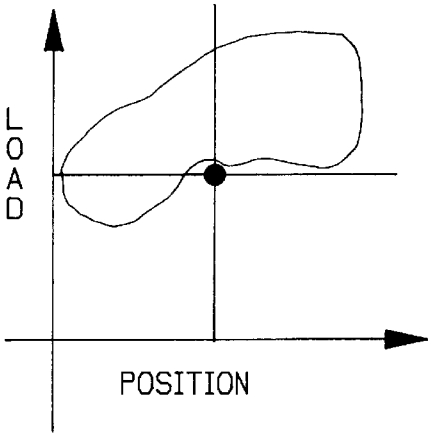

FIGS. 3C and 3D depict an alternative approach for detection of the pumped-off condition. FIG. 3E depicts the well prior to pump-off, while FIG. 3D depicts the well after pump-off has occurred. In accordance with this particular prior art technique, the particular load on the sucker rod at a particular position of the sucker rod is utilized as a threshold for the determination of when pump-off occurs. In FIG. 3C, the load versus position data is such that a determination can be made that the well is not in a pumped-off condition; however, in FIG. 3D, the load and position data has passed the threshold or marker for identification of the pumped-off condition.

The techniques of FIGS. 3A–3D merely represent two common prior art techniques for detection of pump-off in a well; other equally useful and advantageous approaches exist, but will not be discussed in this application, since they are well known by those having average skill in the art.

Figure 4:
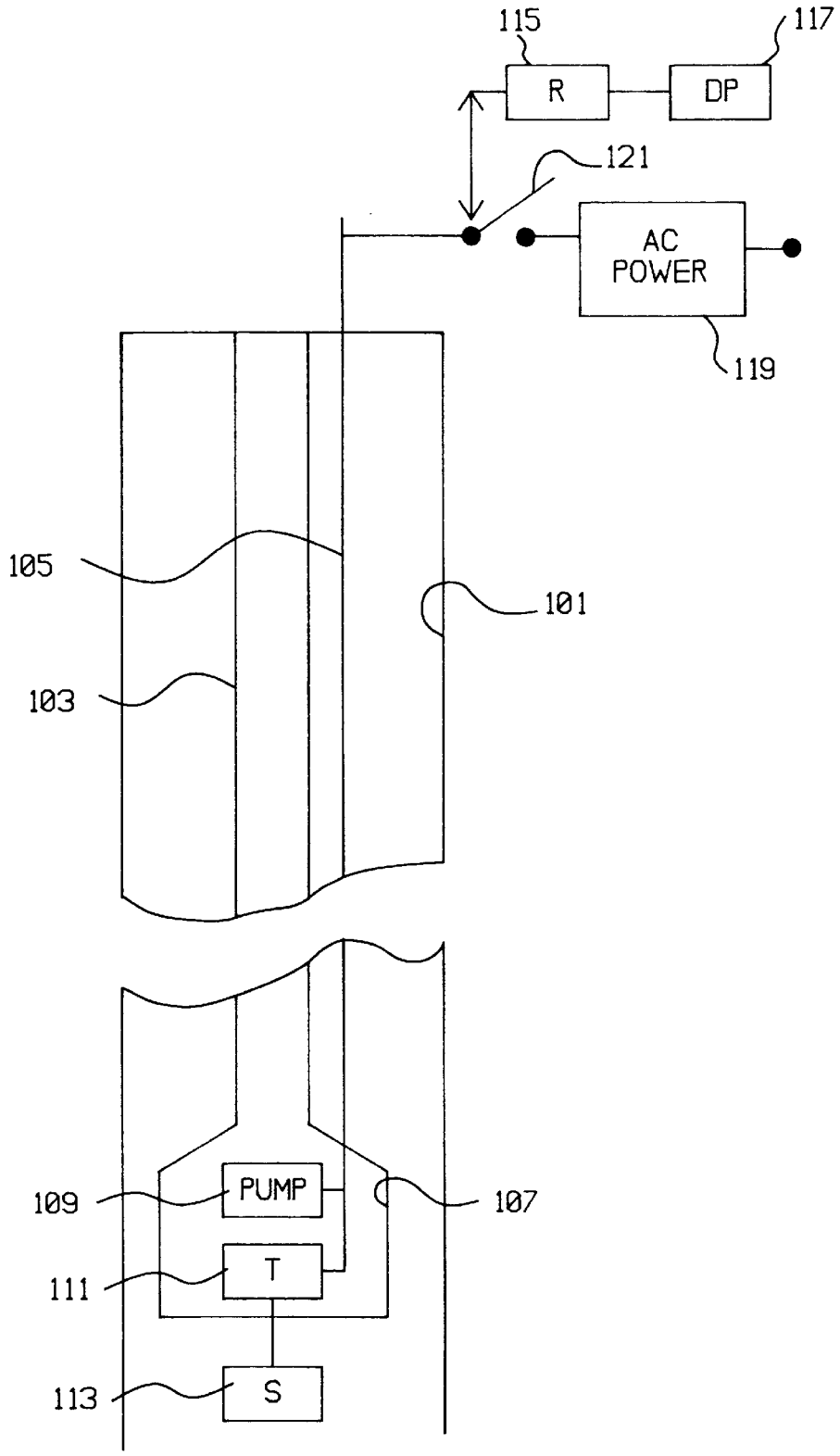
FIG. 4 is a block diagram representation of a submersible pumping system.

FIG. 4 is a block diagram representation of a submersible pump system which is utilized to pump producible fluids from a wellbore location to a service location. As is shown, pump housing 107 is secured to the lowermost end of tubing string 103 which is disposed within wellbore 101. A power cable 105 extends from a surface location downward to pump housing 107. Typically, power cable 105 is secured to the exterior surface of production tubing string 103. Power cable 105 provides electrical power to pump 109 which is disposed within pump housing 107. Sensor 113 may be disposed either within or outside of pump housing 107, and provides an indication of whether the well is pumped-off. Sensor 113 provides data to transmitter 111, which impresses a data stream over power cable 105 to a surface location for receipt by receiver 115. Receiver 115 provides the data to data processor 117 which determines whether or not pump-off is occurring. If pump-off is occurring, data processor 117 operates switch 121 to disconnect AC power 119 from power cable 105. A variety of conventional data transmission systems exist for use with submersible pumps. In the current state-of-the-art, it is useful to have temperature and pressure data telemetered over the power cable to surface equipment. Examples of conventional prior art telemetry systems include those described and claimed in U.S. Pat. No. 4,581,613, entitled "Submersible Pump Telemetry System", U.S. Pat. No. 4,631,536, entitled "Multiplex Submersible Pump Telemetry System", U.S. Pat. No. 4,803,483, entitled "Downhole Pressure and Temperature Monitoring System", and U.S. Pat. No. 4,901,070, entitled "Pressure Monitoring System With Isolating Means", all of which are owned by Baker Hughes Incorporated of Houston, Tex., and which are incorporated herein by reference as if set forth fully herein.

Figure 5:
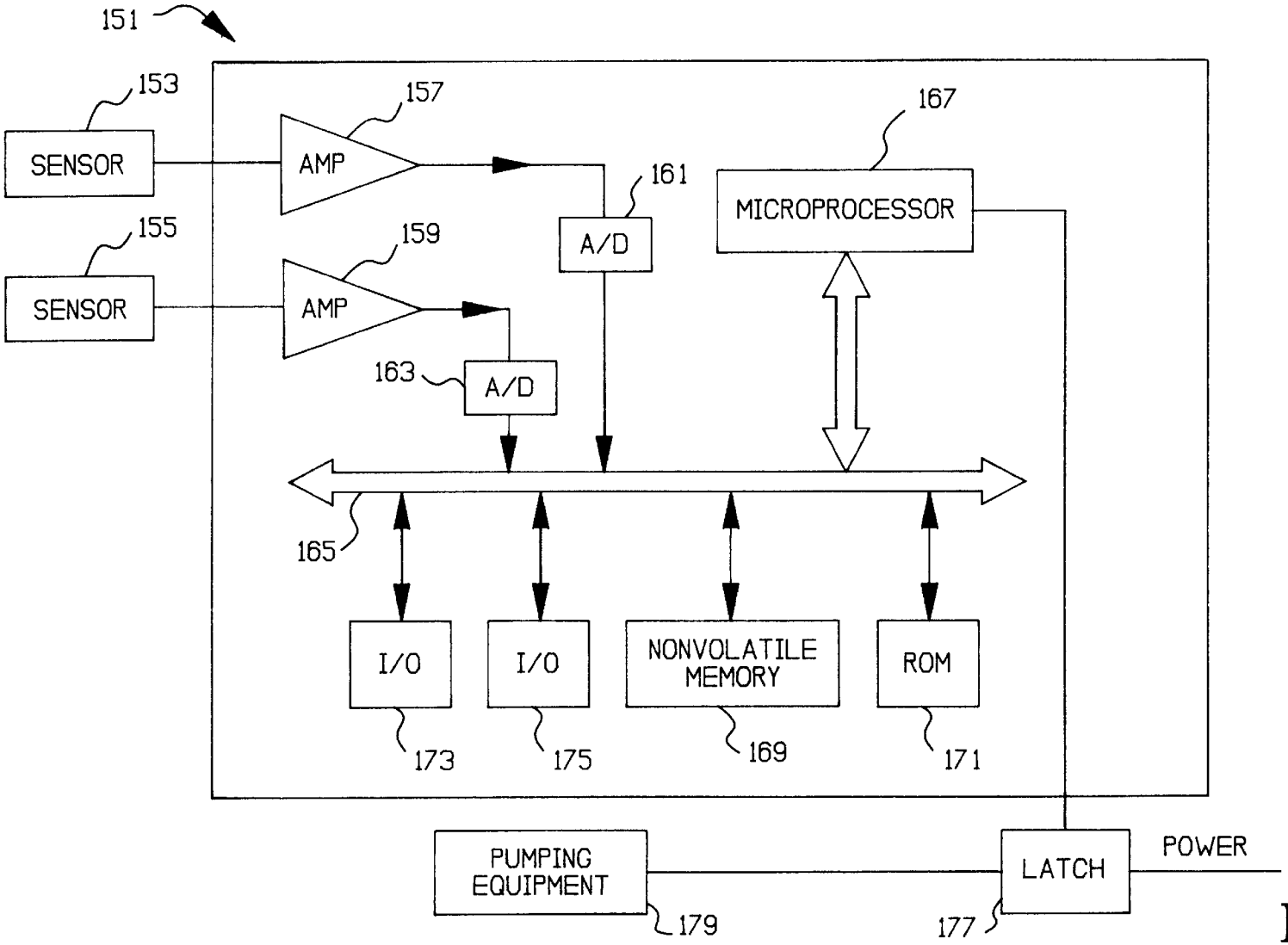
FIG. 5 is a block diagram representation of a data processing system which may be programmed in accordance with the present invention to control pumping operations.

FIG. 5 is a block diagram representation of a data processing system which may be programmed in accordance with the present invention to control pumping operations, by controlling the supply of power to artificial lift production equipment. As is shown, data processing system 151 receives sensor data from sensors 153, 155; preferably, at least load data is provided to data processing system 151 (for sucker rod pumping systems); additionally, position or other data may be supplied to data processing system 151, all of which of course depends upon the particular algorithm utilized by data processing system 151 to detect a pumped-off condition. Data processing system 151 includes amplifiers 157, 159 for amplifying the raw sensor data provided by sensors 153, 155. Additionally analog-to-digital converters 161, 163 are utilized to convert the analog signal to a digital signal. Preferably, the operation of the analog-to-digital converters 161,163 is controlled by either a clock signal, or directly by microprocessor 167. The digital signals are pushed onto data bus 165 for manipulation by microprocessor 167. Preferably, the digital data signals are stored in non-volatile memory 169 by operation of microprocessor 167, until microprocessor 167 is ready to perform pump-off detection calculations. The various routines which are executed by microprocessor 167 may be maintained in program code in ROM 171. Microprocessor 167 loads the contents of the program from ROM 171 during booting operations, as is conventional. Various input/output devices may be provided within data processing system 151 to allow communication to and from data processing system 151. In the example of FIG. 5, input/output devices 173, 175 are provided. These input/output devices may correspond to the radio frequency data transmission systems depicted in FIG. 1A. Microprocessor 167 preferably provides a control signal to an electrically-actuated latch 177 which controls the communication of electrical power to pumping equipment 179. When microprocessor 167 determines that a pumped-off condition exists, a command signal is provided to latch 177 to discontinue the electrical power transmission to pumping equipment 179. Further, in accordance with the present invention, microprocessor 167 determines an optimum idle time which establishes the duration of interruption of the transmission of power through latch 177 to pumping equipment 179.

The present invention is directed to a method and apparatus for controlling the pumping cycle of an artificial lift system, and in particular is directed to a method and apparatus for automatically determining and adjusting the duration of the idle time portion of a pumping cycle. In accordance with the present invention, a "pumping cycle" is defined by the duration of consecutive pumping intervals and idle intervals. In accordance with the present invention, pumping operations continue until the data processing system determines, in accordance with the particular pump-off algorithm, that the well is in a 3pumped-off condition. The data processing system then interrupts the flow of electrical power to the pumping equipment, and maintains the interruption of power for an idle time duration which is calculated in accordance with the present invention. The preferred embodiment of the present invention is depicted in the flowcharts of FIGS. 6, 7, and 8.

Figure 6:
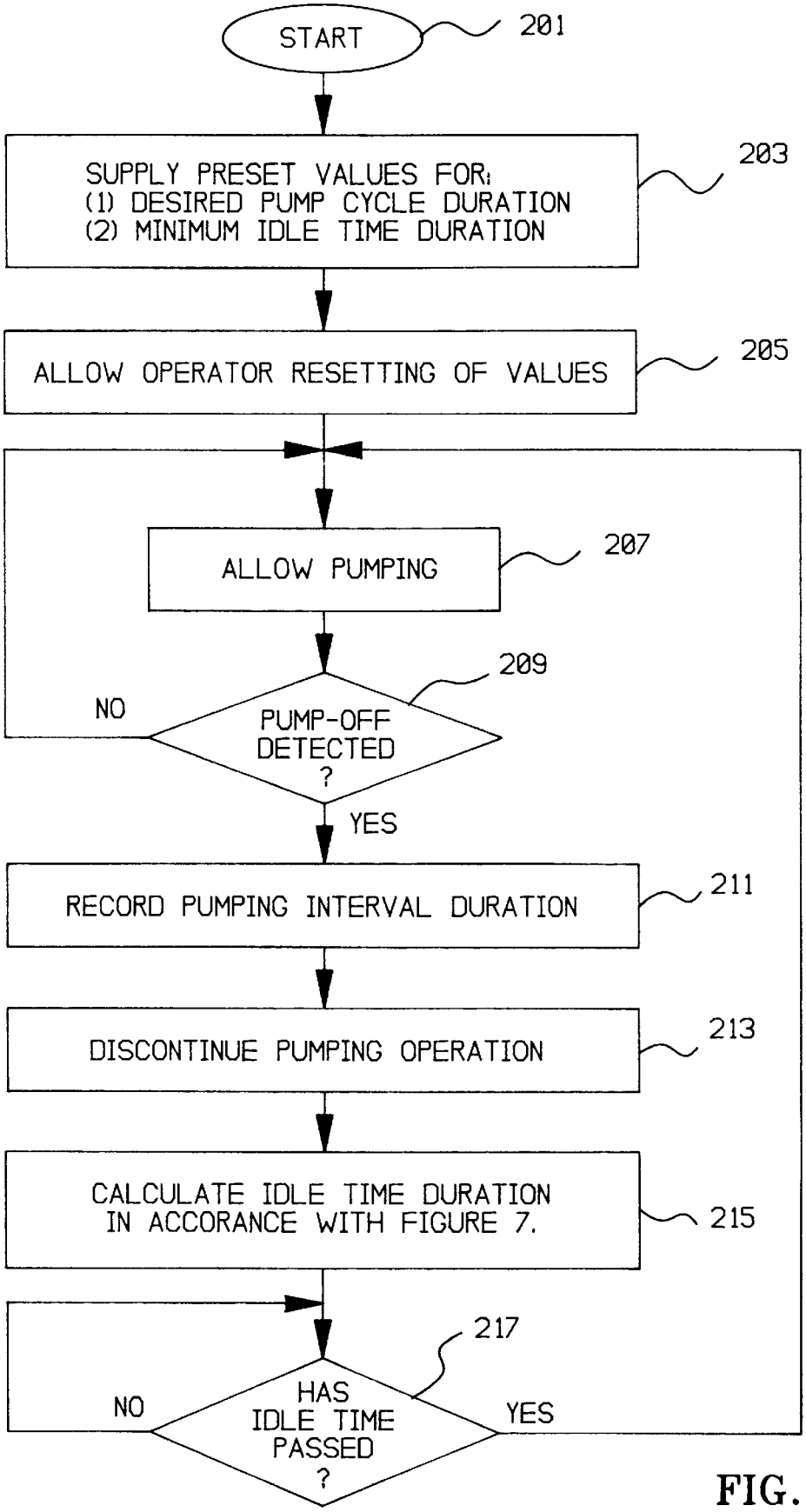
FIGS. 6, 7, and 8 depict the preferred embodiment of the present invention for automatically determining and adjusting the duration of the idle time portion of a pumping cycle.

With reference now to FIG. 6, there is depicted in flowchart form a broad representation of the preferred embodiment of the present invention. The process begins at software block 201, and continues at software block 203, wherein preset values are supplied for (1) a desired pump cycle duration, and (2) a minimum idle time duration. As stated above, the pump cycle is defined as the duration of consecutive pumping intervals and idle intervals. These preset values may be included as factory default values for pump-off controlling equipment. For example, the default value for the desired pump cycle duration may be set to twenty minutes of cycle time. Additionally, the duration of the minimum idle time may be set to two minutes. Then, in accordance with step 205, the data processing system allows the operator to reset these values. This is particularly important during installation operations in the oil and gas producing fields. The operator may observe the pumping activity of a particular well for a sufficient interval to determine better values for the desired pump cycle duration and the minimum idle time duration.

In accordance with step 207, the data processing system allows pumping operations to be performed with the artificial lift system; however, in accordance with software block 209, the data processing system continuously monitors the sensor data to determine if a pumped-off condition exists. If no pump-off is detected, pumping operations are allowed to continue; however, once pump-off is detected, the process continues at software block 211, wherein the data processing system records the pumping interval duration of the previous pumping interval. Next, in accordance with software block 213, the data processing system discontinues pumping operations, preferably by interrupting the flow of electrical power to the artificial lift pumping equipment. Then, in accordance with software block 215, the data processing system calculates idle time duration in accordance with the flowchart of FIG. 7, which will be discussed next. In accordance with software block 217, the data processing system then initiates a software clock, and continually polls the clock to determine if the idle time interval has passed, in accordance with software block 217. Once it has been determined that the idle time has passed, the process returns to software block 207, by allowing the continuation of pumping operations. Preferably, this is accomplished by allowing electrical energy to flow to the artificial lift pumping equipment. The process thus loops continually and does not end unless interrupted by a power failure or fault condition.

Figure 7:
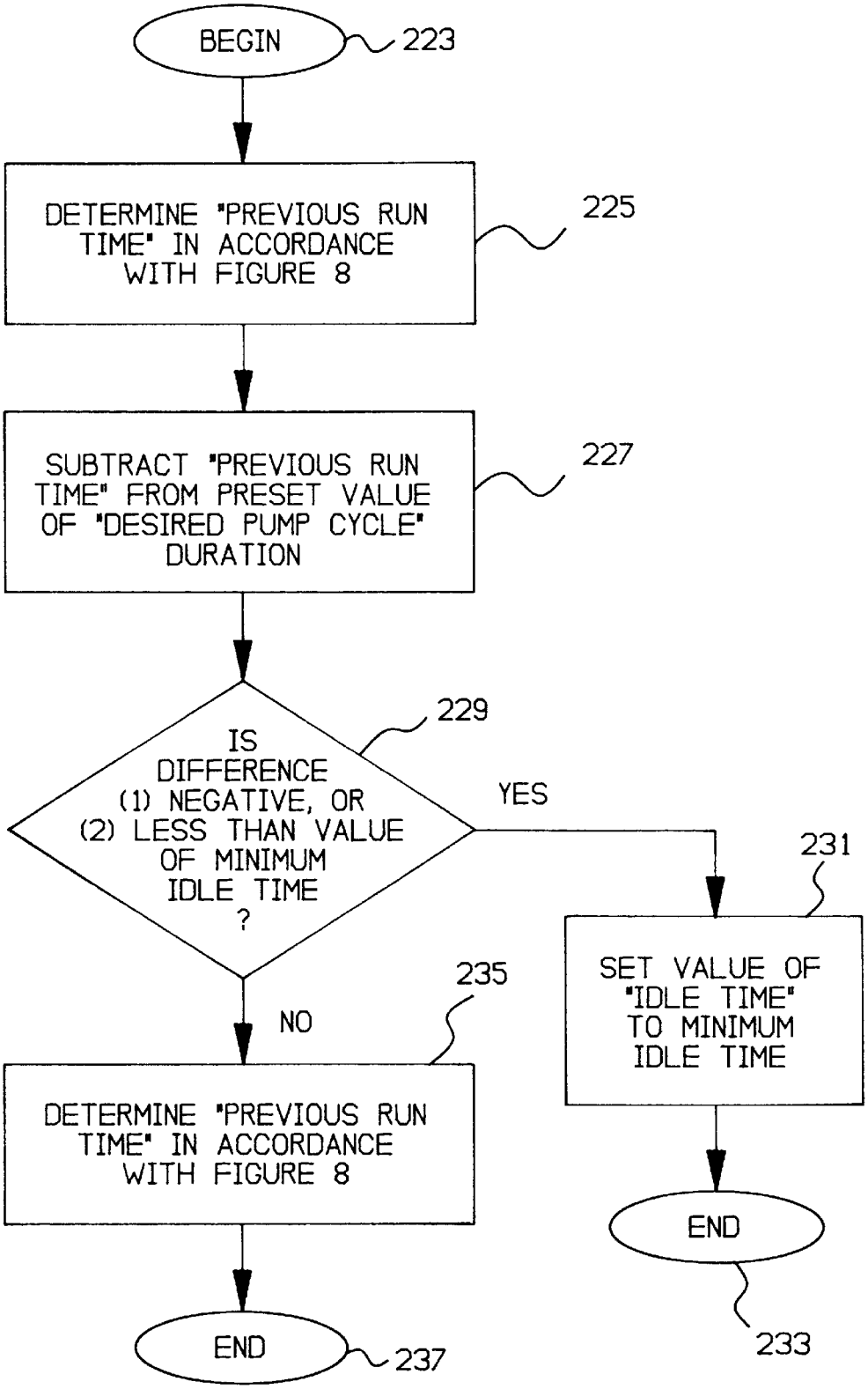
Figure 8:
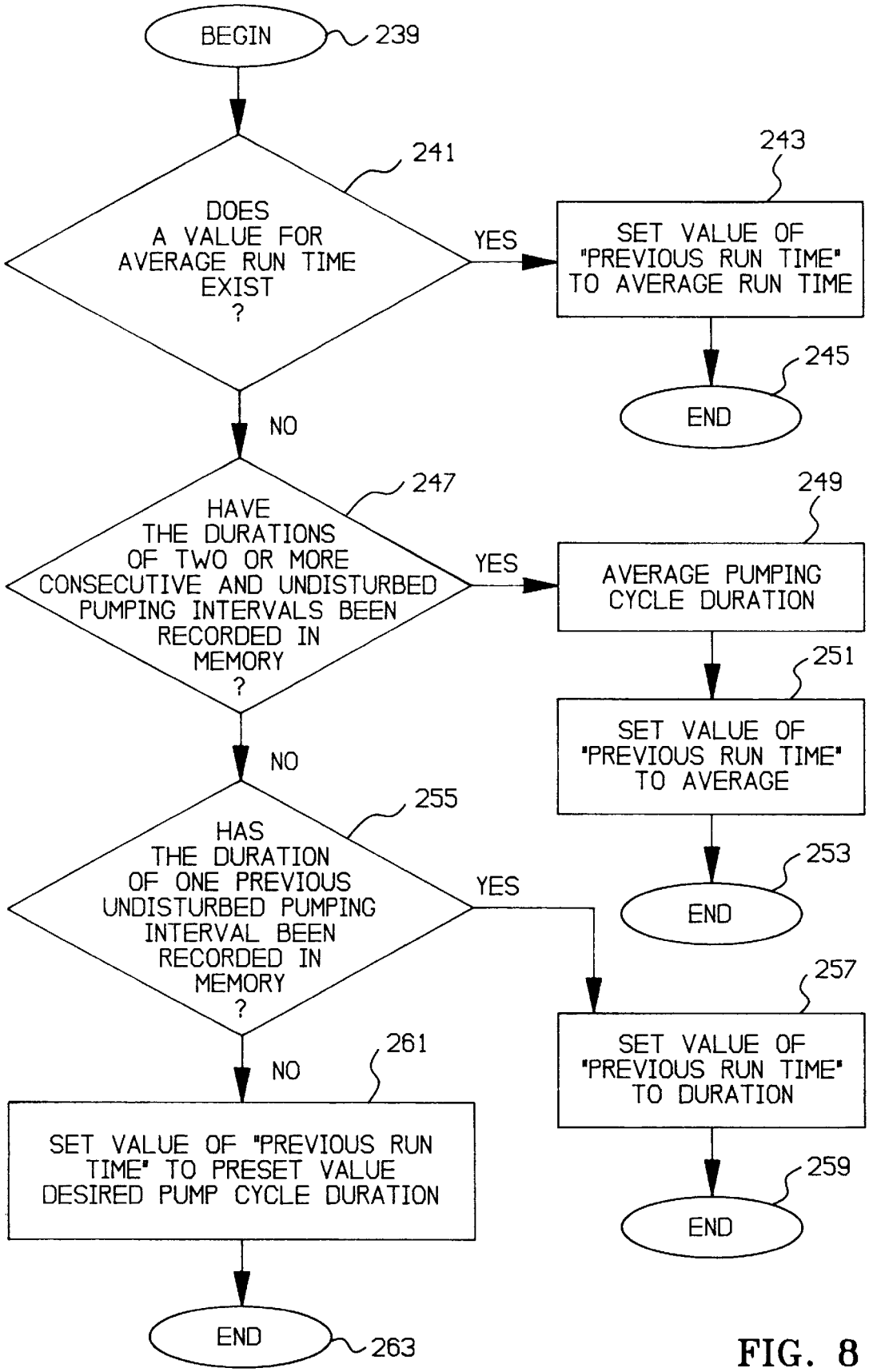

With reference now to FIGS. 7 and 8, the preferred embodiment of the technique for determining the duration of the idle time will now be described. Turning first to FIG. 7, the process begins at software block 223, and continues at software block 225, wherein data processing system 151 determines the "previous run time" in accordance with the flowchart of FIG. 8. Next, in accordance with software block 227, the value of the previous run time is subtracted from the preset value of the "desired pump cycle" duration. Next, in accordance with software block 229, data processing system 151 determines whether the difference between the "previous run time" and the "desired pump cycle" is either (1) negative, or (2) less than a preset value for the minimum idle time. If it is determined in the step of software block 229 that the difference is either negative or less than a preset value for the minimum idle time, the process continues at software block 231, wherein the value of the "idle time" is set to the preset value for the minimum idle time duration, and the process ends at software block 223; however, if it is determined in the step of software block 229 that the difference between the "previous run time" and the "desired pump cycle" is not negative, and not less than the value of the minimum idle time, the process continues at software block 235, wherein the value of the "idle time" is set to the difference between the "previous run time" and the "desired pump cycle". Then, the process ends at software block 237. In this manner, the duration of the idle time is always at least as much as the preset value for the minimum idle time duration. For example, if the value of the preset idle time is preset by the operator to three minutes, in no event will the idle time for any pumping cycle be less than the preset value of three minutes; however, if the difference between the "previous run time" and the "desired pump cycle" is greater than the minimum preset value of three minutes, then the idle time for the next pump cycle will be automatically set to that difference.

FIG. 8 is a high-level flowchart representation of the technique of the preferred embodiment for determining the value of the "previous run time". The process begins at software block 239, and continues at software block 241, wherein data processing system 151 determines whether there is recorded in memory a value for the average run time for relatively long intervals of operation; if it is determine in step 241 that such a value exists, then in accordance with software step 243, data processing system 151 automatically sets the value of the "previous run time" variable to this average run time, and ends at software block 245; however, if it is determined in step 241 that no such average run time value exists, then the process continues at software block 247. In software block 247, data processing system 151 determines whether the durations of two or more consecutive and undisturbed pumping intervals have been recorded in memory. If so, the process continues at software block 249 by averaging the durations of the pumping cycles, and then setting the value of the "previous run time" variable to the average of the pumping cycle durations. The process then ends at step 253. However, if it is determined in software block 247 that the durations of two or more consecutive and uninterrupted pumping intervals have not been recorded in memory, the process continues at software block 255. In accordance with software block 255, data processing system 151 is utilized to determine if the duration of one previous undisturbed pumping interval has been recorded in memory; if so, the process continues at software block 257 by setting the value of the "previous run time" variable to the duration for that particular one previous undisturbed pumping interval, and the process ends at software block 259. However, if it is determined in software block 255 that the duration of one previous undisturbed pumping interval has not been recorded in memory, then the process continues at software block 261. In accordance with software block 261, data processing system 151 sets the value of the "previous run time" variable to the preset value of the desired pump cycle duration, and the process ends at software block 263.

In accordance with the flowchart of FIG. 8, the data processing system 151 is utilized to identify and then utilize the best available information on the duration of the most recent uninterrupted pumping cycles. A long term average run time is the best data, and is preferentially selected over other available values, in accordance with software blocks 241, 243, and 245. If such data is not available, then the durations of two or more consecutive and understand pumping intervals is then utilized to define the value of the "previous run time" variable, in accordance with software blocks 247, 249, 251, and 253. If information relating to the duration of two or more consecutive and undisturbed pumping intervals is not available, then the information relating to the duration of one previous undisturbed pumping interval is then used in accordance with software blocks 255, 257, 259. Finally, if no better data is available, data processing system 151 utilizes the preset value of the desired pump cycle as the value of the "previous run time" variable. This will of course result in a difference of less than the preset idle interval, resulting in (in accordance with FIG. 7) the utilization of the preset idle interval for the idle time duration value.

In accordance with the preferred embodiment of the present invention, the software operations depicted in flowchart form in FIGS. 6, 7, and 8 are continuously and automatically performed during monitoring operations. Therefore, the duration of the idle time is continuously adjusted. If increases are experienced in the duration of the pumping intervals of the pumping cycles, then data processing system 151 automatically and continuously adjusts the idle time duration downward, but not less than the preset minimum value for the idle time duration. In contrast, if the duration of the pumping interval of the pumping cycles decreases, then data processing system 151 automatically and continuously adjusts the duration of the idle time upwardly, but in no event would the idle time equal or exceed the preset value for pump cycle duration. When it is known by the operator that the artificial lift equipment (either sucker rod pumps or submersible pumps) is grossly larger in capacity than the production from the particular well, it is recommended that relatively short durations be established for the desired pumping cycle duration, in order to avoid loss of production.

Figure 9:
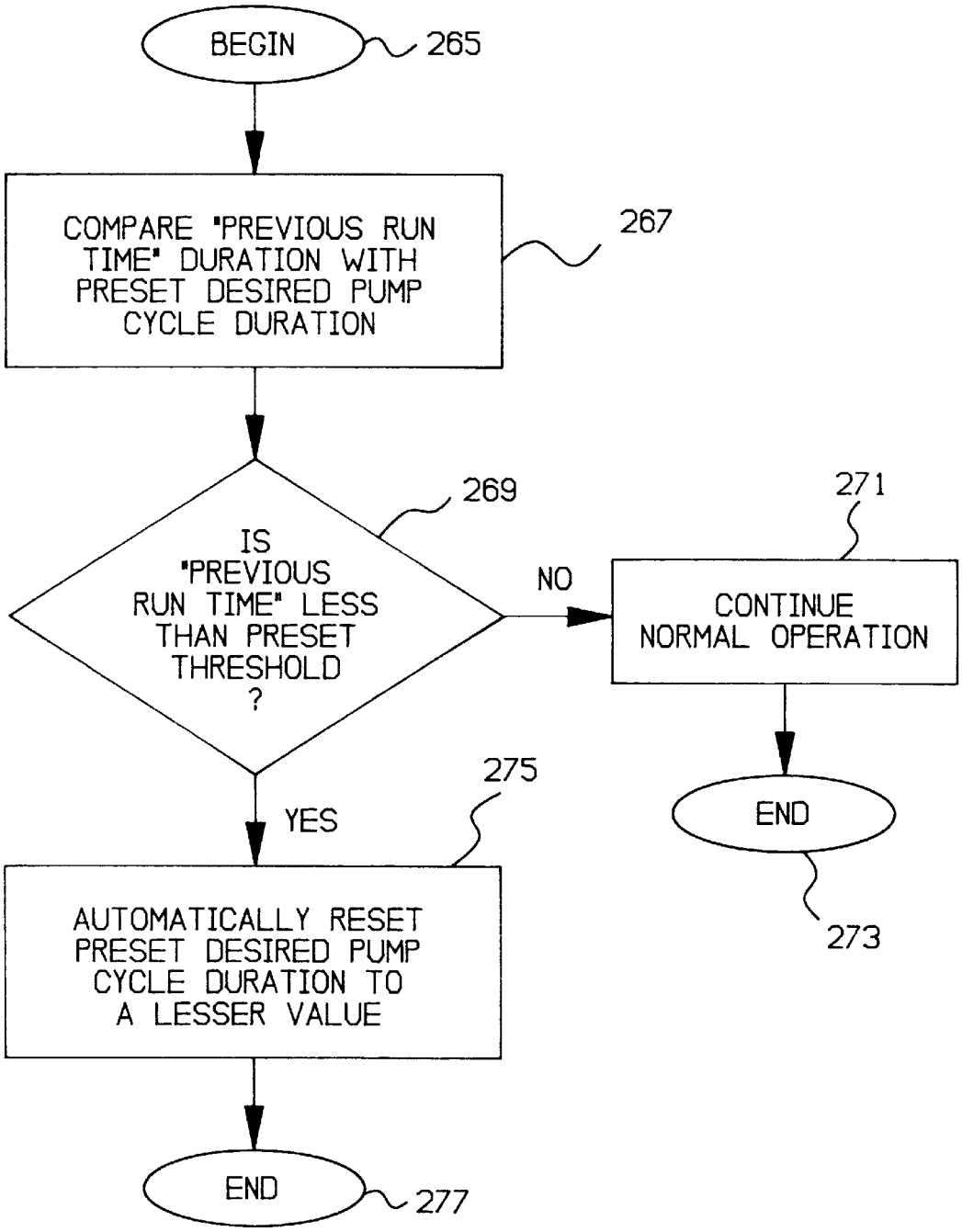
FIG. 9 is a flowchart representation of one preferred technique in accordance with the present invention for automatically adjusting the control over artificial lift equipment in the event of overly large pumping capacity.

FIG. 9 is a flowchart representation of a technique in accordance with the present invention for automatically adjusting the control over the artificial lift equipment if it is determined that such a gross overly large pumping capacity exists. The process commences at software block 265, and continues at software block 267, wherein data processing system 151 compares the value for the "previous run time" with the preset desired pump cycle duration. Then, in accordance with software block 269, data processing system 151 determines whether the "previous run time" value is less than a preselected threshold. For example, the threshold may be a determination that the "previous run time" value is fifty percent or less in duration than the preset desired pump cycle duration. If it is determined in software step 269 that the threshold has not been violated, the process continues at software block 271, wherein normal operation is continued, and the process ends at software block 273. However, if it is determined in software block 269 that the "previous run time" value is less than a preestablished percentage of the preset desired pump cycle duration, then the process continues at software block 275, wherein data processing system 151 automatically resets the preset desired pump cycle duration to a lesser value. For example, data processing system 151 may decrease the preset desired pump cycle duration by ten percent each time a violation of the threshold is determined to have occurred. In this manner, the pumping cycle is automatically continuously adjusted in order to take into account the mismatch between the artificial lift equipment and the production capabilities of the particular well in question. Additionally, a preset minimum pump cycle duration may be set. For example, the pump cycle duration minimum may be set to a value of ten minutes. In this event, no automatic and continuous adjustment of the pump cycle duration could result in a setting of a duration for the pumping cycle which is less than the ten minute threshold. In accordance with the present invention, a fault lamp at the surface of the wellbore may be automatically illuminated to indicate to the operator that the pumping equipment is operating with a pump cycle duration which is less than the preset pump cycle duration. This will prompt the operator to examine the well closely to determine if some mechanical problem exists, or if rapid changes in production volume have been occurring.

While the invention has been shown in only one of its forms, it is not thus limited but is susceptible to various changes and modifications without departing from the spirit thereof.

What is claimed is:

1. A control system for use with an artificial lift system which operates to lift production fluid from a wellbore in response to operation of a prime mover, comprising:

at least one sensor for detecting at least one mechanical attribute during pumping operations and developing at least one electrical signal corresponding thereto;

a controller member for (a) receiving said at least one electrical signal as an input (b) analyzing said at least one electrical signal in order to determine if a pumped-off condition is occurring, (c) providing command signals to control said prime mover to suspend operation if it is determined that a pumped-off condition is occurring; and (d) maintaining suspension of said prime mover for an idle interval having a duration which is calculated by said controller from (1) at least one preceding pumping interval, and (2) a predefined pump cycle duration.

2. A control system for use with an artificial lift system, according to claim 1:

wherein said controller member comprises a microcomputer with memory, and a program resident in memory which executes instructions in order to accomplish predetermined program objectives.

3. A control system for use with an artificial lift system, according to claim 1:

wherein said idle interval which is utilized by said controller member to effect control over said prime mover is continuously calculated during control operations.

4. A control system for use with an artificial lift system, according to claim 1:

wherein said idle interval which is utilized by said controller member to effect control over said prime mover is determined with respect to preceding pumping intervals in a manner which maintains said pump cycle at a substantially constant predetermined pump cycle duration.

5. A control system for use with an artificial lift system, according to claim 1:

wherein said control member broadly manages operation of said prime mover by maintaining a substantially constant and predetermined pumping cycle, while substantially continuously adjusting durations of consecutive pumping intervals and idle intervals in a manner dependent upon at least one previous pumping interval duration and actual detection of said pump-off condition.

6. A control system for use with an artificial lift system, according to claim 5:

wherein experienced increases in duration of said pumping interval result in corresponding decreases in duration of said idle interval.

7. A control system for use with an artificial lift system, according to claim 6:

wherein experienced decreases in duration of said pumping interval result in corresponding increases in duration of said idle interval.

8. A control system for use with an artificial lift system, according to claim 1, wherein said controller member is further utilized for:

(e) automatically adjusting said predefined pump cycle duration in response to changes experienced in said pumping interval.

9. A control system for use with a sucker rod pumping unit which includes (a) a reciprocating rod extending downward through production tubing in a wellbore, (b) a travelling valve member and a standing valve member which cooperate to lift production fluid within said production tubing, (c) a prime mover for reciprocating said reciprocating rod, comprising:

at least one sensor for detecting at least one mechanical attribute during pumping operations and developing at least one electrical signal corresponding thereto;

a controller member for (a) receiving said at least one electrical signal as an input (b) analyzing said at least one electrical signal in order to determine if a pump-off condition is occurring, and (c) providing command signals to control said prime mover in a manner which is at least partially dependent upon whether or not said pump-off condition is occurring;

wherein control of said prime mover by said control member is obtained with respect to:

(a) a pumping interval; and (b) an idle interval; and (c) a pump cycle which is defined by the duration of consecutive pumping intervals and idle intervals;

by utilizing an idle interval which is derived from a predetermined pump cycle and at least one historical value of said pumping interval; and wherein said idle interval which is utilized by said controller member to effect control over said prime mover is determined with respect to preceding pumping intervals in a manner which maintains said pump cycle at a substantially constant predetermined pump cycle value.

10. A control system for use with a sucker rod pumping unit, according to claim 9:

wherein said at least one sensor includes a position sensor for determining a position of said reciprocating rod.

11. A control system for use with a sucker rod pumping unit, according to claim 9:

wherein said at least one sensor includes a load sensor for determining the axial load on said reciprocating rod.

12. A control system for use with a sucker rod pumping unit, according to claim 9:

wherein said controller member comprises a microcomputer with memory, and a program resident in memory which executes instructions in order to accomplish predetermined program objectives.

13. A control system for use with a sucker rod pumping unit, according to claim 9:

wherein said idle interval which is utilized by said controller member to effect control over said prime mover is continuously calculated during control operations.

14. A control system for use with a sucker rod pumping unit, according to claim 9:

wherein said control member broadly manages operation of said prime mover by maintaining a substantially constant and predetermined pumping cycle, while substantially continuously adjusting durations of consecutive pumping intervals and idle intervals in a manner dependent upon at least one previous pumping interval duration and actual detection of said pump-off condition.

15. A control system for use with a sucker rod pumping unit, according to claim 14:

wherein experienced increases in duration of said pumping interval result in corresponding decreases in duration of said idle interval.

16. A control system for use with a sucker rod pumping unit, according to claim 14:

wherein experienced decreases in duration of said pumping interval result in corresponding increases in duration of said idle interval.

17. A method of controlling an artificial lift system which operates to lift production fluid from a wellbore in response to operation of a prime mover, comprising the method steps of:

providing at least one pump-off detection sensor for detecting a pumped-off condition in said wellbore;

providing a controller member;

utilizing said controller member to substantially continuously monitor said at least one pump-off detection sensor during pumping operations, and to suspend operation of said prime mover upon detection of a pumped-off condition for an idle interval;

utilizing said controller member to calculate a duration for said idle interval from (1) at least one preceding pumping interval, and (2) a predefined pump cycle duration.

18. A method of controlling an artificial lift system, according to claim 17, wherein said controller substantially continuously calculates said duration of said idle interval during pumping operations.

19. A method of controlling an artificial lift system, according to claim 17, wherein said controller member operates to maintain a substantially constant and predetermined pumping cycle.

20. A method of controlling an artificial lift system, according to claim 19, wherein said controller member operates to maintain a substantially constant and predetermined pumping cycle by continuously adjusting said idle interval.

21. A method of controlling an artificial lift system, according to claim 17, further comprising:

further utilizing said controller member to automatically modify said predefined pump cycle duration in response to detection of changes in said at least one preceding pumping interval.

22. A method of controlling a sucker rod pumping unit which includes (a) a reciprocating rod extending downward through production tubing in a wellbore, (b) a travelling valve member and a standing valve member which cooperate to lift production fluid within said production tubing, (c) a prime mover for reciprocating said reciprocating rod comprising the method steps of:

utilizing a sensor to detect at least one mechanical attribute during pumping operations;

developing at least one electrical signal corresponding to detection of said at least one mechanical attribute;

analyzing said at least one electrical signal to determine if a pumped-off condition is occurring;

suspending operation of said prime mover upon detection of said pumped-off condition;

maintaining suspension of operation of said prime mover for an idle interval having a duration which is calculated from (1) at least one preceding pumping interval, and (2) a predefined pump cycle duration;

maintaining a substantially constant and predetermined pumping cycle duration by continuously adjusting said idle interval duration.

23. A method of controlling a sucker rod pumping unit, according to claim 22, wherein said duration of said idle time is calculated from (1) an average of preceding pumping interval durations, and (2) a predefined pump cycle duration.

* * * * *